US011821721B2

(12) United States Patent
Smith

(10) Patent No.: US 11,821,721 B2
(45) Date of Patent: Nov. 21, 2023

(54) AMMUNITION COMPONENT AND METHOD OF FORMING SAME

(71) Applicant: Lyndon Smith, Orillia (CA)

(72) Inventor: Lyndon Smith, Orillia (CA)

( * ) Notice: Subject to any disclaimer, the term of this patent is extended or adjusted under 35 U.S.C. 154(b) by 0 days.

(21) Appl. No.: 17/744,794

(22) Filed: May 16, 2022

(65) Prior Publication Data

US 2023/0051965 A1 Feb. 16, 2023

Related U.S. Application Data

(60) Provisional application No. 63/195,730, filed on Jun. 2, 2021.

(51) Int. Cl.
*F42B 5/285* (2006.01)
*F42B 5/307* (2006.01)
*F42B 33/14* (2006.01)

(52) U.S. Cl.
CPC ..... *F42B 5/285* (2013.01); *F42B 33/14* (2013.01)

(58) Field of Classification Search
CPC .... F42B 5/28; F42B 5/285; F42B 5/30; F42B 5/307
See application file for complete search history.

(56) References Cited

U.S. PATENT DOCUMENTS 3,099,958 A * 8/1963 Daubenspeck ..... F42B 7/06 86/19.5
3,170,401 A * 2/1965 Johnson ..... F42B 5/18 102/467
3,491,691 A * 1/1970 Vawter ..... B29C 43/00 102/467
3,559,581 A * 2/1971 Kriz ..... B29C 45/2708 425/468
3,577,924 A * 5/1971 Findlay ..... F42B 5/313 102/448
3,675,576 A * 7/1972 Whitney ..... F42B 5/313 102/466
3,688,699 A * 9/1972 Horn ..... F42B 7/06 102/466
3,690,256 A * 9/1972 Schnitzer ..... F42B 5/307 102/465
3,749,021 A * 7/1973 Burgess ..... F42B 5/30 102/467
3,955,506 A * 5/1976 Luther ..... F42B 5/307 102/467
4,140,058 A * 2/1979 Ballreich ..... B29C 66/73132 102/466
4,192,233 A * 3/1980 Dumortier ..... F42B 5/313 102/466
4,569,288 A * 2/1986 Grelle ..... F42B 5/313 102/466

(Continued)

*Primary Examiner* — Derrick R Morgan
(74) *Attorney, Agent, or Firm* — Paul S. Sharpe; The Sharpe Group

(57) ABSTRACT

A grinding/polishing unit operation for rendering a mirror finish and precise tolerance to the base of an ammunition article. A diamond wheel is used in a live tooling operation where the diamond wheel has a mating profile to the base to be ground/polished. Bases can be prepared from bar stock or pre-existing bases can be treated to enhance magazine loading ease, ejection ease post firing and a reduction in the tendency for spent propellant residue from accreting on the bases. Several embodiments for the unit operation are disclosed.

12 Claims, 11 Drawing Sheets

(56) References Cited

U.S. PATENT DOCUMENTS

| | | | | |
|---|---|---|---|---|
| 5,021,206 | A * | 6/1991 | Stoops | F42B 5/313 102/466 |
| 5,048,421 | A * | 9/1991 | Swartout | F42B 5/18 102/431 |
| 7,059,234 | B2 * | 6/2006 | Husseini | F42B 12/76 86/55 |
| 9,157,709 | B2 | 10/2015 | Nuetzman | |
| 10,041,771 | B1 * | 8/2018 | Burrow | F42B 5/30 |
| 10,041,777 | B1 * | 8/2018 | Burrow | F42B 5/30 |
| 10,260,847 | B2 * | 4/2019 | Viggiano | F42B 33/0207 |
| 10,415,943 | B2 * | 9/2019 | Burrow | F42B 5/313 |
| 10,612,896 | B2 | 4/2020 | Viggiano | |
| 10,704,879 | B1 * | 7/2020 | Burrow | F42C 19/083 |
| 2005/0241203 | A1 * | 11/2005 | Lizotte | F41A 21/12 42/1.01 |
| 2008/0184873 | A1 * | 8/2008 | Martini Filho | F42B 5/025 86/1.1 |
| 2012/0060716 | A1 * | 3/2012 | Davies | F42B 5/26 102/469 |
| 2014/0224144 | A1 * | 8/2014 | Neugebauer | F42B 5/307 102/470 |
| 2014/0260925 | A1 * | 9/2014 | Beach | F42B 33/0207 86/28 |
| 2017/0261299 | A1 * | 9/2017 | Burrow | F42B 5/30 |
| 2018/0202788 | A1 * | 7/2018 | Burrow | F42B 5/30 |
| 2018/0306559 | A1 * | 10/2018 | Eberhart | F42C 19/083 |
| 2019/0368845 | A1 * | 12/2019 | VanBuskirk | F42B 5/285 |
| 2020/0182594 | A1 * | 6/2020 | Imhoff | F42B 5/285 |
| 2020/0408492 | A1 * | 12/2020 | Bandini | F42B 5/285 |
| 2021/0080237 | A1 * | 3/2021 | Burrow | F42B 5/307 |

* cited by examiner

AMMUNITION COMPONENT AND METHOD OF FORMING SAME

FIELD OF THE INVENTION

The present invention relates to optimizing ammunition casing formation and more particularly, the present invention relates to methods for forming consistently high precision dimensional tolerance casing assemblies created for longevity in high reuse situations.

BACKGROUND OF THE INVENTION

Precision in ammunition dimensions is of paramount importance to ensure safe operation when discharging rounds. If precision is not observed, the round can be difficult, if not impossible, to feed into the firing chamber from an ammunition magazine and may also become jammed when casing ejection is required. Further still, "stovepiping" can occur when the casing becomes lodged partway from the ejector port.

Enthusiasts generally collect the casings from discharged ammunition in order to have the casing recharged and the ammunition refurbished for further use of the casings. This is a cost saving measure but can compromise the dimensional characteristics of the casing base and/or casing in light of the extreme pressures and temperatures attributed to detonation and release of the projectile. After repeated use, the base of the casing may be fatigued or have irregularities with respect to performance.

Generally, casing cylinders and/or casing bases are made of low carbon steel, aluminum or castings. The widely used technique to produce a high tolerance diameter casing is by employing a screw machine (a computer numerical control, CNC,) process.

The casings and bases are usually manufactured in very high production run amounts, typically ranging in the millions of pieces. As the tooling wears, the dimensional consistency can be affected. One such inconsistency can be seen in concentricity of the casing itself and dimensional variation in the diameter of the bases.

In the prior art, there are a number of documents proposing solutions to the known problems in reuse of spent ammunition components.

As an example, Viggiano, in U.S. Pat. No. 10,260,847, issued Apr. 16, 2019, teaches:

"Embodiments of the present invention comprise a sleeve which is made of an austenitic stainless steel that is hardened and magnetic, and the base is made of a softer metal, such as aluminum base alloy.

The mechanical aspects of the invention are concentrated on first in the following description. A casing of the present invention may be made of different materials and combinations of materials. Preferably, as discussed in greater detail below, a sleeve is made of austenitic stainless steel having a martensitic microstructure and the base is a wrought aluminum alloy."

Further elaboration is made with respect to the steel in the Viggiano disclosure:

"In the generality of the invention which involves the foregoing mechanical features, a sleeve may be made of iron alloys (e.g., steels) and preferably other alloys having iron, aluminum, and copper base. As noted just above, the best performance of an invention casing/cartridge is achieved when the material of the sleeve has high strength.

Preferably, an exemplary sleeve of a casing of the present invention is made of a kind of austenitic stainless steel which is cold worked sufficient to form a martensitic microstructure, to thereby selectively both harden and make magnetic the steel, compared to the same steel in its annealed condition. A preferred material for the base is 7075 wrought aluminum alloy in T6 temper.

A preferred austenitic stainless steel is AISI 304 stainless steel alloy. Other alloys which preferentially may be used include AISI 302, AISI 308, and AISI 347. Casings of the foregoing and like-behaving alloys are used in the cold worked condition, without annealing. The select alloys have a desirable combination of formability, corrosion resistance, and strength. In their annealed condition the alloys are not magnetic: when cold worked during casing fabrication they are magnetic. For what "magnetic" means, see explanation below connected with Table 1. In the preferred materials, a deformation-induced martensite (a ferromagnetic phase) is present when the material is cold worked and not-annealed: and that makes the material advantageously attracted by a common magnet. Preferred alloys of the invention are in a special class. For example, the austenitic stainless steel, AISI 316, is not magnetic when a casing is cold-worked as described herein. For example, casings made of stainless steels of the AISI 400 series, the steel is ferritic and magnetic, regardless of working or presence of martensite."

Although a very useful disclosure, there is no specific discussion as to the use of the 400 series steel for the bases, but rather the discussion is directed to aluminum for this component. As an enhancement to this disclosure, a mirror finished base composed of, for example, series 400 stainless steel, would further enhance, not only the above-mentioned application, but also casings and bases therefor generally.

The disclosure also has teachings regarding the presence of a wave shaped projection forming a gap between the casing base and casing cylinder. The text teaches:

"FIG. 8 is a view of casing 220 mated with base 224. Nipple 228 runs lengthwise within the smaller diameter passageway portion 256 of passageway 230 of base 224. The bulkhead 226 of the casing comprises a circular ridge, called a wave here. FIG. 9 is a partial lengthwise cross section of sleeve 222 before it is locked together with the base 224. The Figures show a sleeve 222 and base 224 which are like those of the casing 120, but for the presence of a wave 250 in the bulkhead 226. The circular or annular wave 250 is centered on the length axis C and the nipple length. When viewed in lengthwise cross section as in FIG. 9, wave 250 gives the bulkhead an irregular contour as it runs radially.

A preferred bulkhead has a wave that (a) creates a depression on the exterior side of the bulkhead (that facing the base) and (b) is not restrained by engagement with the abutting surface of the base. The wave defines an annular depression or hollow 258 on the exterior surface of the bulkhead. The bulkhead is preferably of constant thickness and is in contact with or in very close or intimate proximity to the surface 236 at the end of the base; and the wave defines a void space between the bulkhead and the surface 236. When propellant is deflagrated within the casing, the presence of a wave lowers the von Mises stresses at region 240, where the cylindrical sidewall of the sleeve meets the bulkhead. It is believed that the high gas pressure within the casing when gunpowder is ignited causes the wave to elastically deform, or flatten. That allows both the outside circumferences of the bulkhead and the adjacent sleeve cylindrical portion at location 240 to increase—to the point that they contact the bore of the chamber within which the cartridge is positioned, thereby to make momentarily a seal that inhibits flow of gun barrel gases between the casing and the chamber bore. In the invention, there is no ridge or engagement feature on the base surface, and the bulkhead is able to move radially relative to the surface 236. Preferably the aforementioned small radius of curvature is present at region 240 in combination with a wave".

From the teachings of this passage, there is significant movement and deformation between the casing base and casing cylinder.

Nuetzman et al., in U.S. Pat. No. 9,157,709, issued Oct. 13, 2015, discloses a multiple step process for forming a casing cartridge. The disclosure does not delve into mitigation of dimensional variation of the product under high volume production runs.

Burrow, in U.S. Pat. No. 10,612,896, issued Apr. 7, 2020, discloses a method for manufacturing a metal injection molded ammunition cartridge. A stainless steel composition is taught for the casing, however, there is no instruction regarding dimension control during manufacturing or mirror finishing the stainless steel base of the casing.

Kramer Industries online, kramerindustriesonline.com, teaches polishing techniques for returning brass casings to pre-fired shine by using a vibratory bowl machine with walnut shell grit and/or corn cob grit. Although useful, it would be more desirable to impart a finish to the casing during manufacturing that inherently resists accretion of debris, staining, etc.

Midvale Industries Inc., midvaleindustries.com, provides ammunition finishing techniques for new or used casings. These include batch vibratory finishing, continuous vibratory finishing, batch centrifugal finishing and rotary drum washing, as with the Kramer Industries method, these processes are post-manufacturing operations as opposed to preventative treatment measures during manufacturing runs of the casing bases.

In light of the necessity for dimension accuracy and surface cleanliness of ammunition casing bases intended for reuse, there still exists a need for methodology to ensure these attributes as well as mechanical integrity for repeated reuse of casing assemblies.

The present invention addresses such needs.

SUMMARY OF THE INVENTION

One object of the present invention is to provide an improved method of forming ammunition components.

Another object of one embodiment of the present invention is to provide an ammunition casing assembly, comprising:

a. a casing base having a plurality of spaced apart first cooperating engagement members located in a face of the casing base; and b. a casing cylinder having a plurality of spaced apart second cooperating engagement members located in a face of the cylinder, each first cooperating engagement member of the casing base configured for mating cooperative engagement with a respective second cooperating engagement member of the casing cylinder when the respective faces are in contact for preventing relative rotational movement between said casing base and said casing cylinder.

The cooperating engagement members may be either of recesses or projections configured for keyed registration with one another to prevent any relative rotation in use or otherwise. This also provides for the possibility of increasing the amount of propellant, etc. that may be incorporated in the casing cylinder where projections are utilized as the cooperating engagement members.

It has been found that the keyed mechanical consolidation between the casing base and cylinder improves longevity of the casing for reuse, reduces thermal damage over repeated use and permits the use of different metal materials which, in turn, reduces the mass of the casing base and cylinder. The latter is particularly advantageous where military personnel can reduce the mass of material carried in service.

In respect of the cooperating engagement members, any suitable configurations may be employed that can be configured using known machining and metal forming techniques. To this end the recesses may be arced, circular, polygonal, star shaped, etc.

Positioning and configuration geometry of the cooperating engagement members may be radially spaced apart equidistantly with a common radius from the centre of the casing base and cylinder. Alternatively, where different metals are employed for the casing and cylinder, different disposition of the members may be necessary to compensate for different thermal characteristics of the chosen materials. This is also believed to compensate for warping or other dimensional variations which may be ephemeral or lasting.

In respect of the metal, a desirable metal for the casing comprises 400 series martensitic stainless steel.

Treatment comprises a live tooling operation in, for example, a computer numerical control (CNC) overall operation. Other operations will be appreciated by those skilled.

The grinding step imparts a reflective surface to the base which may also be coated using known techniques such as vapour deposition to enhance strength and retard oxidation and debris build-up. Further, the coating may be a strengthening composition, a colour composition, an identification coating, a tracking coating and combinations thereof.

The grinding/polishing may be conducted in concert with a cooling operation using liquid or gas coolant.

Although series 400 stainless steel is most desirable for the casings and bases, other conventional metals or amalgams may be utilized such as brass, aluminum, titanium, inter alia. Suitable selections will be appreciated by those skilled in the art.

Although the use of the 400 series steel for the base provides for simplified recovery of spent casings magnetically, the bases may also incorporate a colour composition, an identification coating, a tracking coating and combinations thereof depending on the intended use.

The grinding step is achieved using a diamond wheel to impart a mirror reflective finish to the casing base. With such a finish there is a reduction in the amount of debris that is attracted to the base post firing and the casing base has a lower coefficient of friction. Further, magazine loading is simplified as is transport therefrom to the firing chamber and subsequent ejection of the spent casing post firing.

Depending on the specific situation, the grinding/polishing may be conducted continuously or discontinuously or in a predetermined sequence of either or both.

To further enhance the strength and surface durability of the casing base, the same may be treated with an additional material to alleviate deflagration damage, surface damage and general durability. Suitable treatment procedures and compositions will be appreciated by those skilled in the art. Examples include vapour deposition of titanium, graphene, chromium, nickel, etc.

The casing and base comprise two pieces, a casing base and casing cylinder or a one-piece structure integrating both.

As a further object of one embodiment of the present invention, there is provided a method of forming a casing for a firearm ammunition, comprising:

a. providing a casing base;
b. forming a plurality of spaced apart first cooperating engagement members located in a face of the casing base;
c. providing a casing cylinder;
d. forming a plurality of spaced apart second cooperating engagement members located in a face of the cylinder, each first cooperating engagement member of the casing base configured for mating cooperative engagement with a respective second cooperating engagement member of the casing cylinder; and
e. contacting the respective faces to connect the casing base and the casing cylinder, where the first cooperating engagement members and the second cooperating engagement members are in registration for preventing relative rotational movement between the casing base and the casing cylinder.

As an option, the method may include further including the step of mechanically connecting the base and the casing with a secondary mechanical connection.

In accordance with yet another object of one embodiment of the present invention is to provide a method for forming an ammunition casing, comprising:

a. providing a formed ammunition casing with a base having a predetermined cross-sectional profile; and
b. grinding said base with a grinder having a mating profile to said base to impart a reflective surface and lower coefficient of friction relative to a preground base.

The grinding step can be applied to single piece casings (casing and base integrated) or those having more than one piece, i.e. a casing and base connected.

Advantageously, the grinding operation may be applied to pre-existing casings with bases to impart a diamond ground mirror finish to the casing.

The grinding technology discussed herein is also useful to grind oversize or otherwise larger diameter bases which may be diamond ground to a predetermined diameter depending on the requirements for the end user or ballistic specifications.

Conveniently, with the grinding step imparted by a diamond wheel, for example, the coefficient of friction of the base is commensurately lowered. This manifests in smooth loading and ejection action, retards oxidation build-up and ensures diameter precision over repeated use.

The method may further include:

a. forming a plurality of spaced apart first cooperating engagement members located in a face of the casing base;
b. forming a plurality of spaced apart second cooperating engagement members located in a face of the cylinder, each first cooperating engagement member of the casing base configured for mating cooperative engagement with a respective second cooperating engagement member of the casing cylinder; and
c. contacting the respective faces to connect the casing base and the casing cylinder, where the first cooperating engagement members and the second cooperating engagement members are in registration for preventing relative rotational movement between the casing base and the casing cylinder.

The method may be conducted in a continuous line operation, a continuous rotational operation or any combination thereof.

Having thus generally described the invention, reference will now be made to the accompanying drawings, illustrating preferred embodiments.

BRIEF DESCRIPTION OF THE DRAWINGS

Similar numerals used in the Figures denote similar elements.

DETAILED DESCRIPTION OF THE PREFERRED EMBODIMENTS

Figure 1:
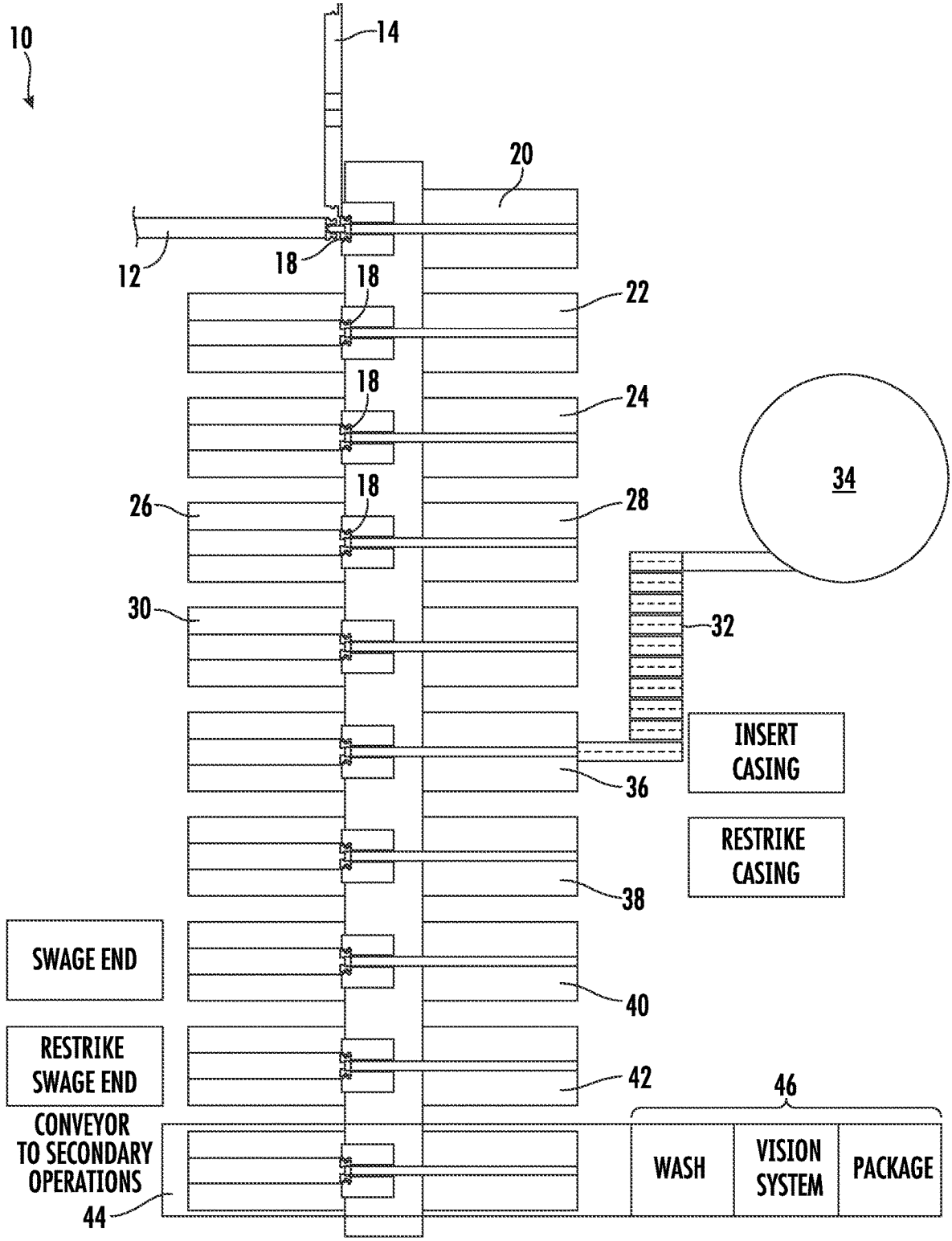
FIG. 1 is a schematic illustration of one possible operation sequence to form a base for ammunition from initial bar stock.

Referring initially to FIG. 1, shown is a schematic illustration of the unit operations attributed to the overall process 10 of forming a base for an ammunition casing.

Figure 1A:
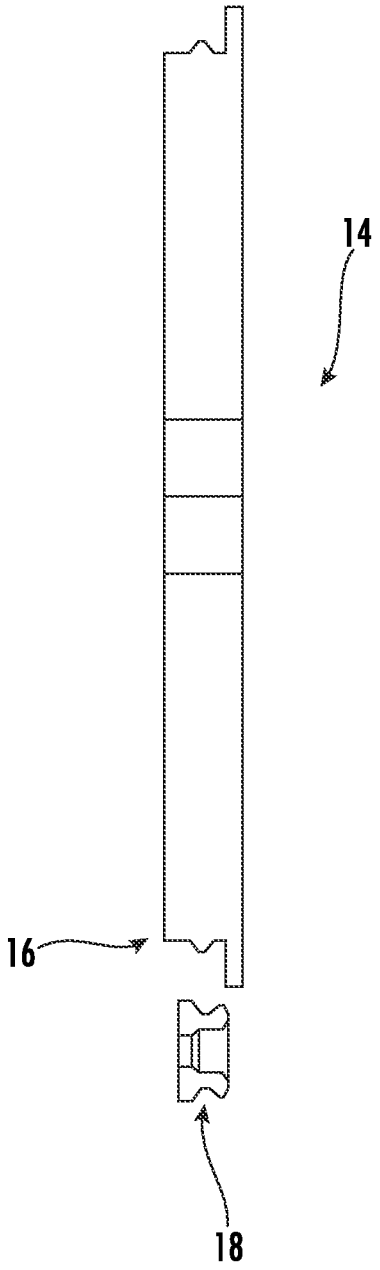
FIG. 1A is an enlarged view of the profiled diamond wheel illustrating the mating profile relative to the base profile.

In a first embodiment, bar stock material 12, which may be selected from, for example, series 400 stainless steel, is introduced for profiling with a diamond wheel 14. Wheel 14 has a predetermined profile to impart the same profile with a specific predetermined tolerance to bar stock 12. FIG. 1A illustrates an enlargement of the profiled segment 16 of the wheel 14. The profile of segment 16 is imparted to bar stock material 12 forming a base 18. Formed base 18 is retained in a mandrel of cell 1 denoted by numeral 20. At this point, base 18 is predrilled in cell 1 (20).

The predrilled casing base 18 is then moved to cell 2, referenced as 22, for a secondary drilling operation. For clarity, the movement of the base 18 may be linearly through the stages of FIG. 1 or rotated in a predetermined sequence. Either the cells or the base may be rotated. Suitable arrangements in this regard will be appreciated by those skilled.

Subsequent to the secondary drilling in cell 2, the base 18 is advanced to cell 3, denoted by numeral 24 for a pre-finishing reaming operation. The next stage, cell 4, (26), exposes the base 18 to a spot face operation and then subsequently to a finishing reaming operation 28 in cell 5. Spot face finishing is completed in cell 6, denoted by numeral 30.

A supply of casing cylinders 32 may be supplied from, for example, a vibratory bowl feeder 34. As is well known in the ammunition art, the casing cylinder 32, receives propellant and a projectile (neither shown).

The casing cylinders 32 positioned from the bowl feeder 34 are then coupled to a respective casing base 18 by well-known methods, an example of which is compression fit. This is broadly referenced at cell 7, denoted by numeral 36. The next steps typically associated with the formation of the based casing include a restrike operation at cell 8, swage end operation at cell 9 and a restrike operation of the swage end at cell 10, represented by numerals 38, 40 and 42, respectively.

Figure 2:
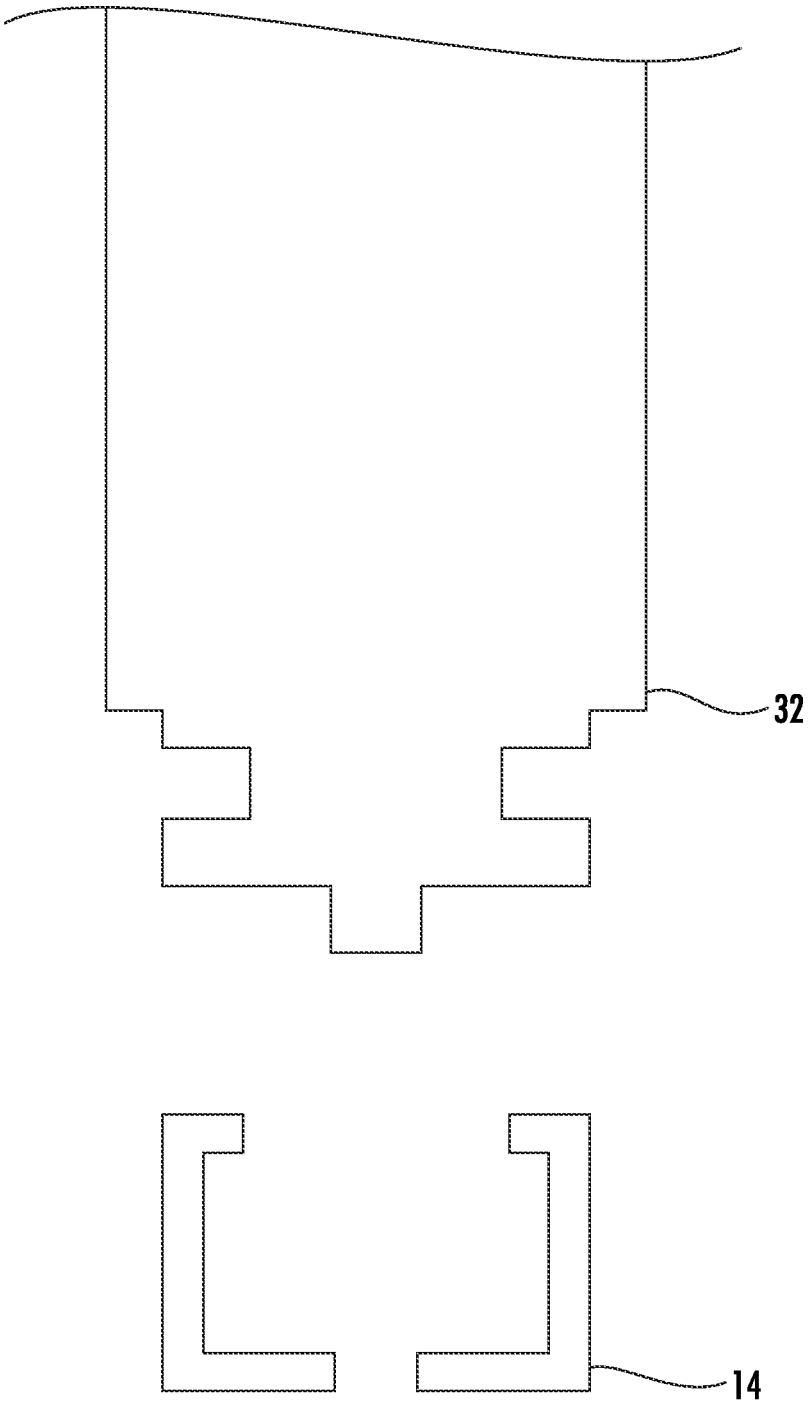
FIG. 2 is an exploded illustration of a casing and base.

FIG. 2 schematically illustrates one possible arrangement for the casing cylinder 32 and casing base 14.

Once completed the based casings (not shown) are conveyed at 44 for secondary operations such as washing, inspection/quality control and packaging all of which are represented by numeral 46.

Figure 3:
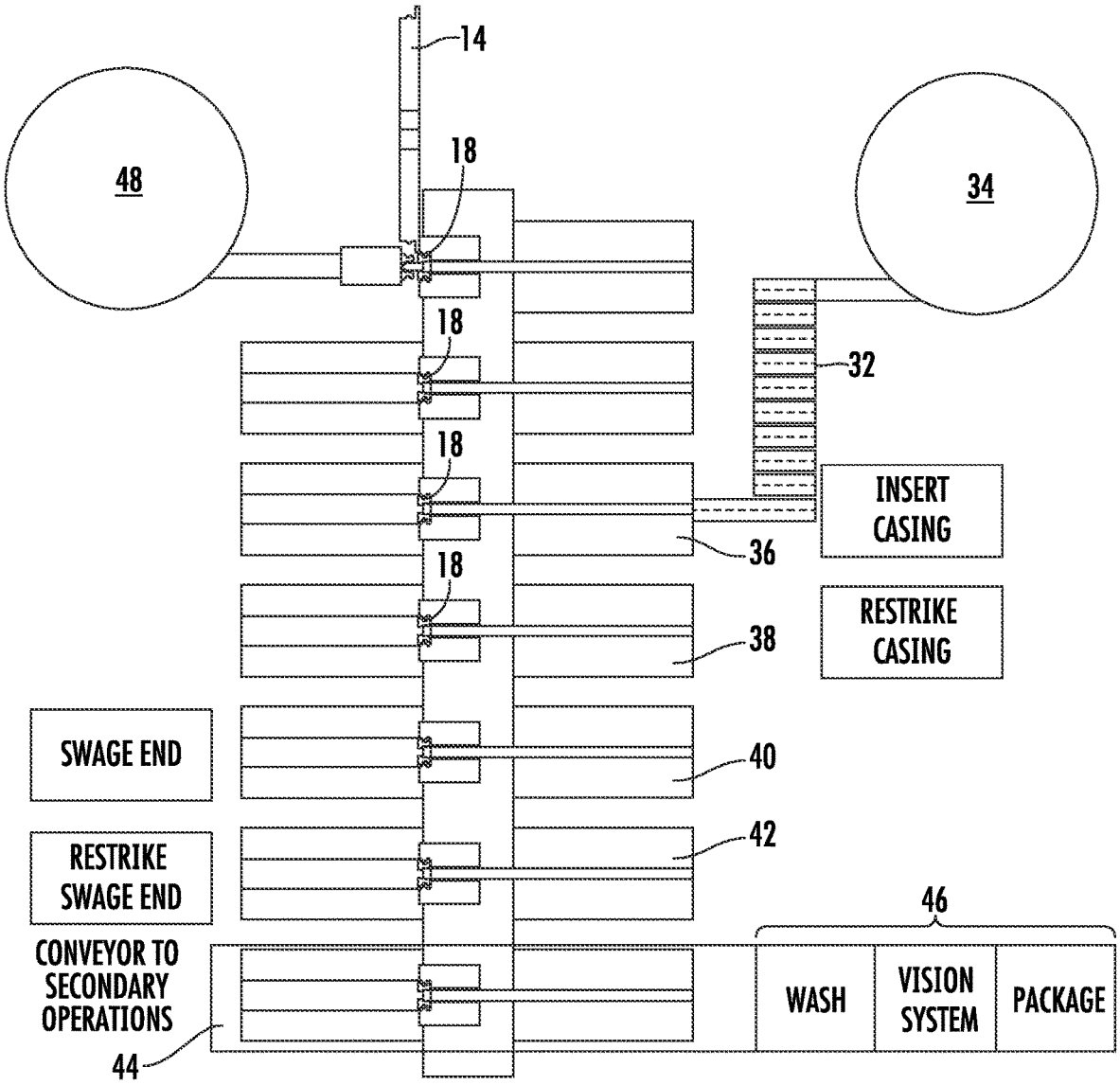
FIG. 3 is a is a schematic illustration of a second possible operation sequence to form a base and casing unit from pre-existing bases and casings.

FIG. 3 depicts an operation where pre-existing bases are supplied from a bowl feeder 48. In this embodiment, the diamond wheel 14 with the matching profile of the casing base 18 is employed to impart a mirror finish to the existing base 18 at a specific diameter to enhance the quality of the overall finished and based casing. The advantages of treating pre-existing bases have been enumerated herein previously.

Figure 4:
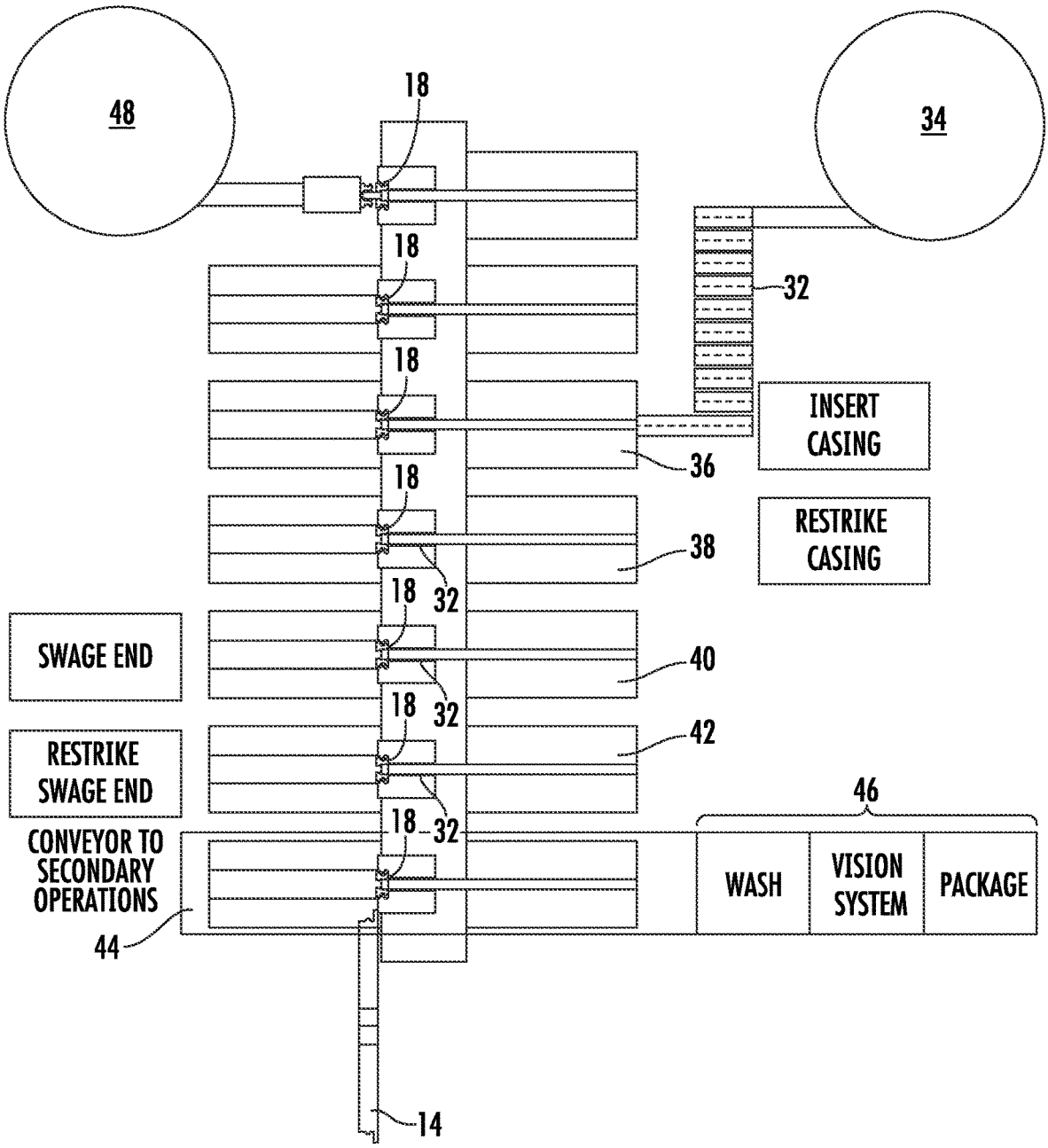
FIG. 4 is schematic illustration of an alternate embodiment of the operation sequence.

FIG. 4 illustrates a further embodiment where the diamond polishing wheel 14 is disposed at the final stage of the operation. In this manner, the casing base 18 attached to the casing 32 is polished as an assembled unit.

In alternate embodiments, the casing and base can be a single piece item made with the bar stock in reference to FIG. 1.

Further, in some instances, it may be desirable to have the casing diamond polished as well as the base. In this alternative, the profile of the diamond wheel would conform to the profile of the casing.

As mentioned herein, the overall process can be done in any number of ways known to those skilled. For example, multiple bases can be treated by a rotational mandrel and the individual operations conducted in a linear or rotational manner.

Figure 5:
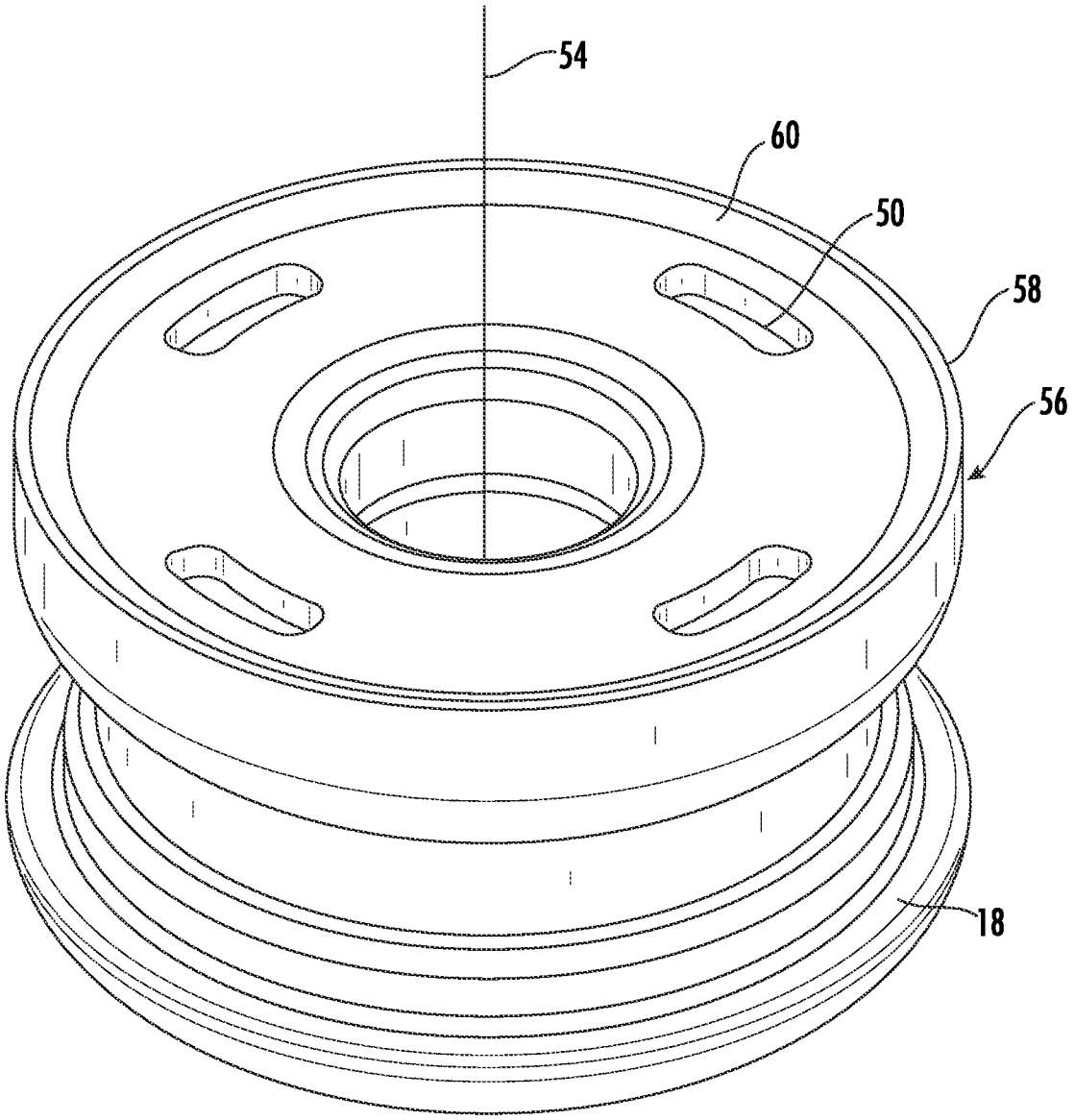
FIG. 5 is a plan view of a casing base according to a first embodiment of the invention.
Figure 6:
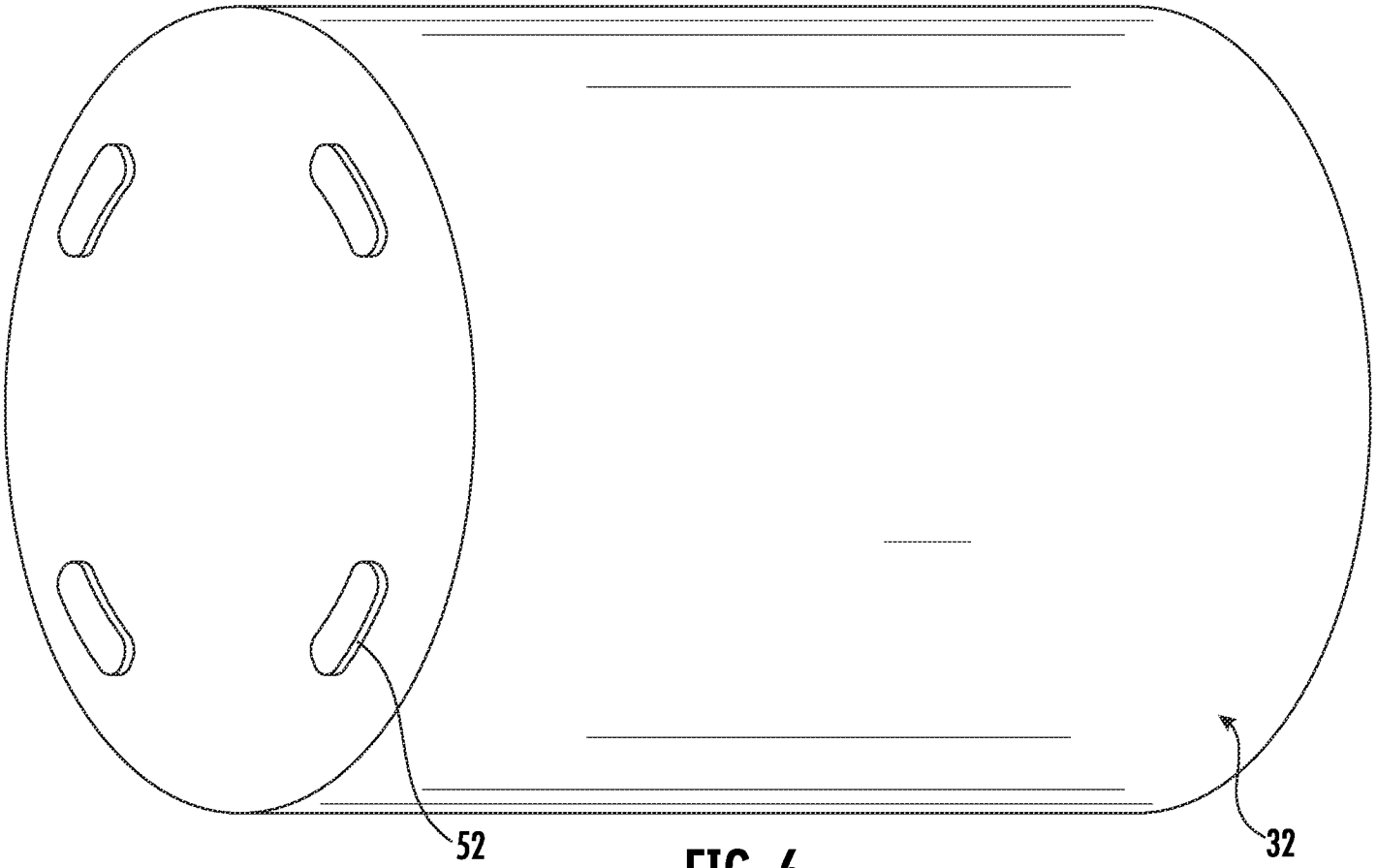
FIG. 6 Is a plan view of a casing cylinder according to a first embodiment of the invention.

In a further embodiment of the technology set forth herein, FIG. 5 illustrates first cooperating engagement members 50 on casing base 18 configured to engage second cooperating engagement members 52 on casing cylinder 32 as shown in FIG. 6.

In the example, the first cooperating engagement members 50 are depicted as a plurality of arcuate recesses. The recesses are equidistantly spaced apart and concentric with the vertical axis 54 of the casing base 18 all with an equal distance from the axis 54. The members 50 are spaced inwardly from the perimeter 56 of the casing base 18 and recessed from the top edge 58 of the casing base. In this manner, a seating is generally formed having a wall 60 surrounding the members 50.

Referring now to FIG. 6, the second cooperating engagement members 52 are configured to be received in members 50 (FIG. 5). The members 50 and 52 may be reversed as projections and recesses or may include combinations of each.

The formation of members 50 and 52 in casing base 18 and casing cylinder 32 may be introduced at a suitable stage in the processing operations delineated in FIGS. 1 through 4. The formation of the members 50 and 52 is not only a manufacturing expedient, but also enhances the mechanical connection between the casing base 18 and casing cylinder 32 to prevent relative rotation therebetween during detonation of the complete ammunition. It is believed that since there is no rotation between the two, the casing assembly, i.e. the connected base 18 and cylinder 32, is not subjected to mechanical fatigue which would otherwise be realized at the connection absent the members 50 and 52. This has a commensurate result in that the assembly can have increased longevity for repeated reuse. The latter is a desirable advantage to enthusiasts since casing assembly jamming is reduced as well as cost to replace assemblies prematurely.

Figure 7:
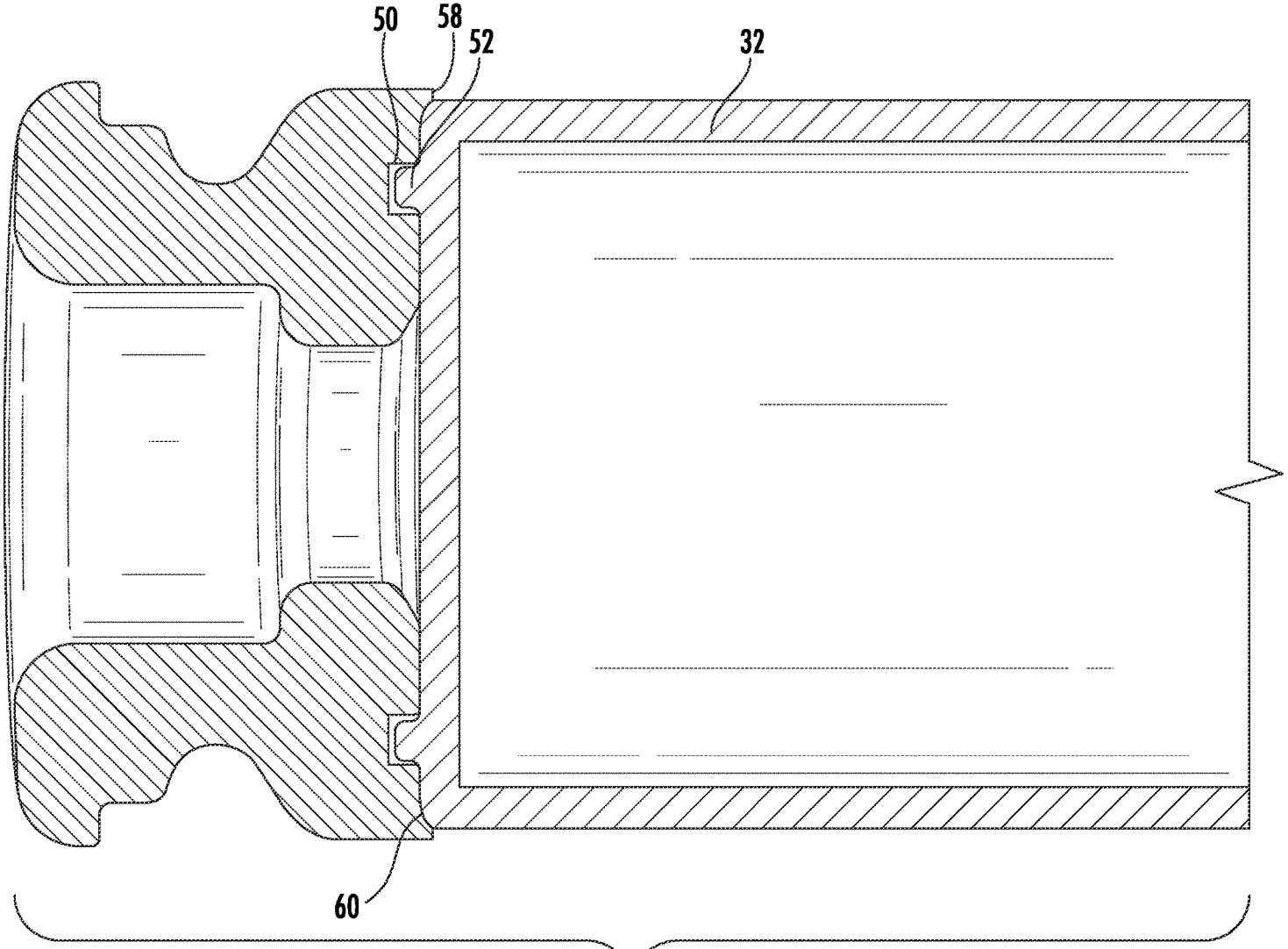
FIG. 7 is a cross section view of the casing assembly with the casing base engaged with the casing cylinder.

FIG. 7 illustrates the casing assembly 62 with the members 50 of casing base 18 engaged with members 52 of casing cylinder 32.

As has been generally stated herein previously, the type of metals used for the base casing 18 and the casing cylinder 32 may be the same or different. This will depend upon the specific user requirements for the ammunition.

Figure 8:
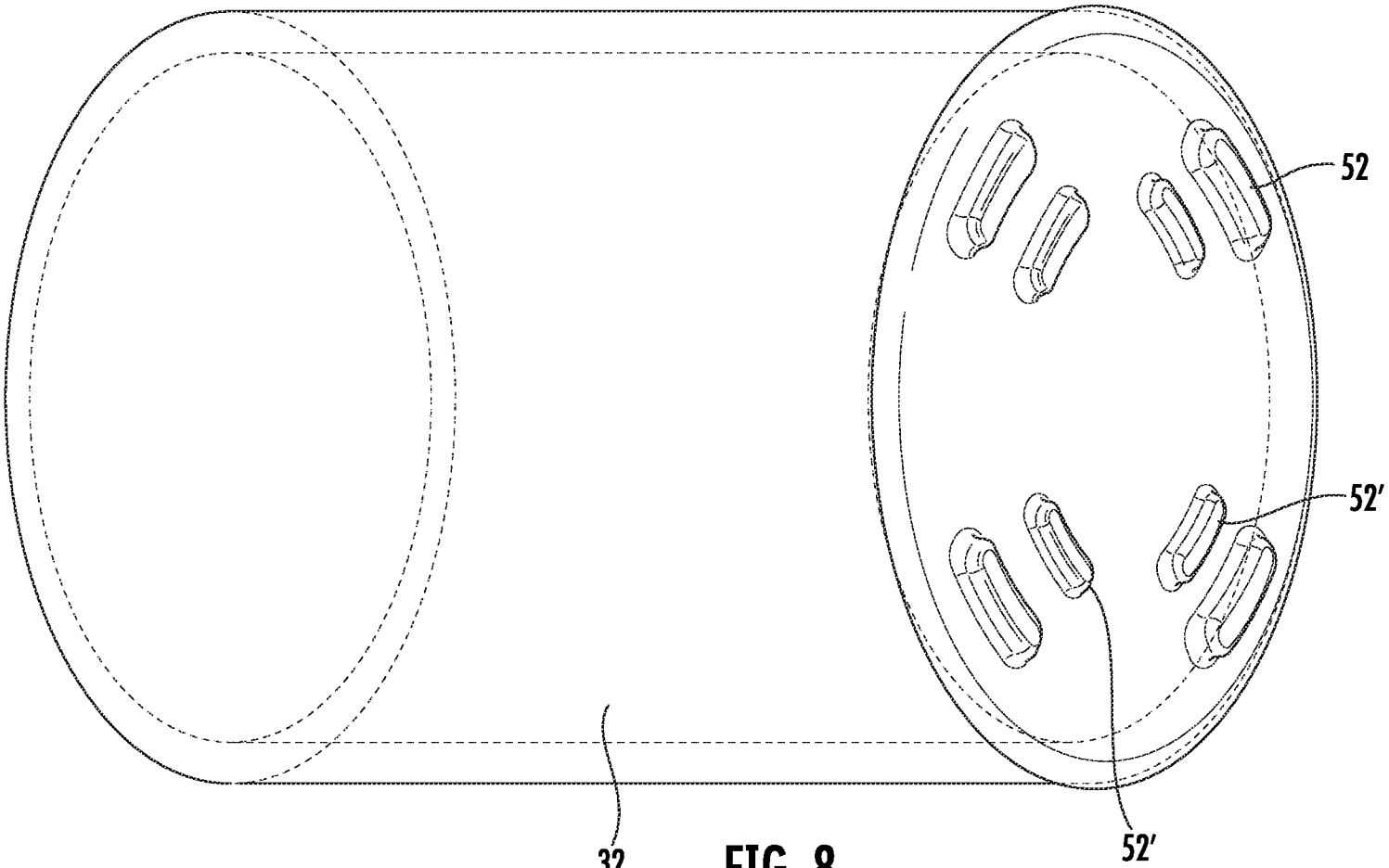
FIG. 8 is a plan view of an alternate embodiment of the casing cylinder.

Turning to FIG. 8, shown is a variation where there is provided a second course of members 52'. The second course is shown in the example as being concentric, aligned with and spaced from members 52. The shape of the members 52' may be the same as that for 52 or different or a combination of these.

Figure 9:
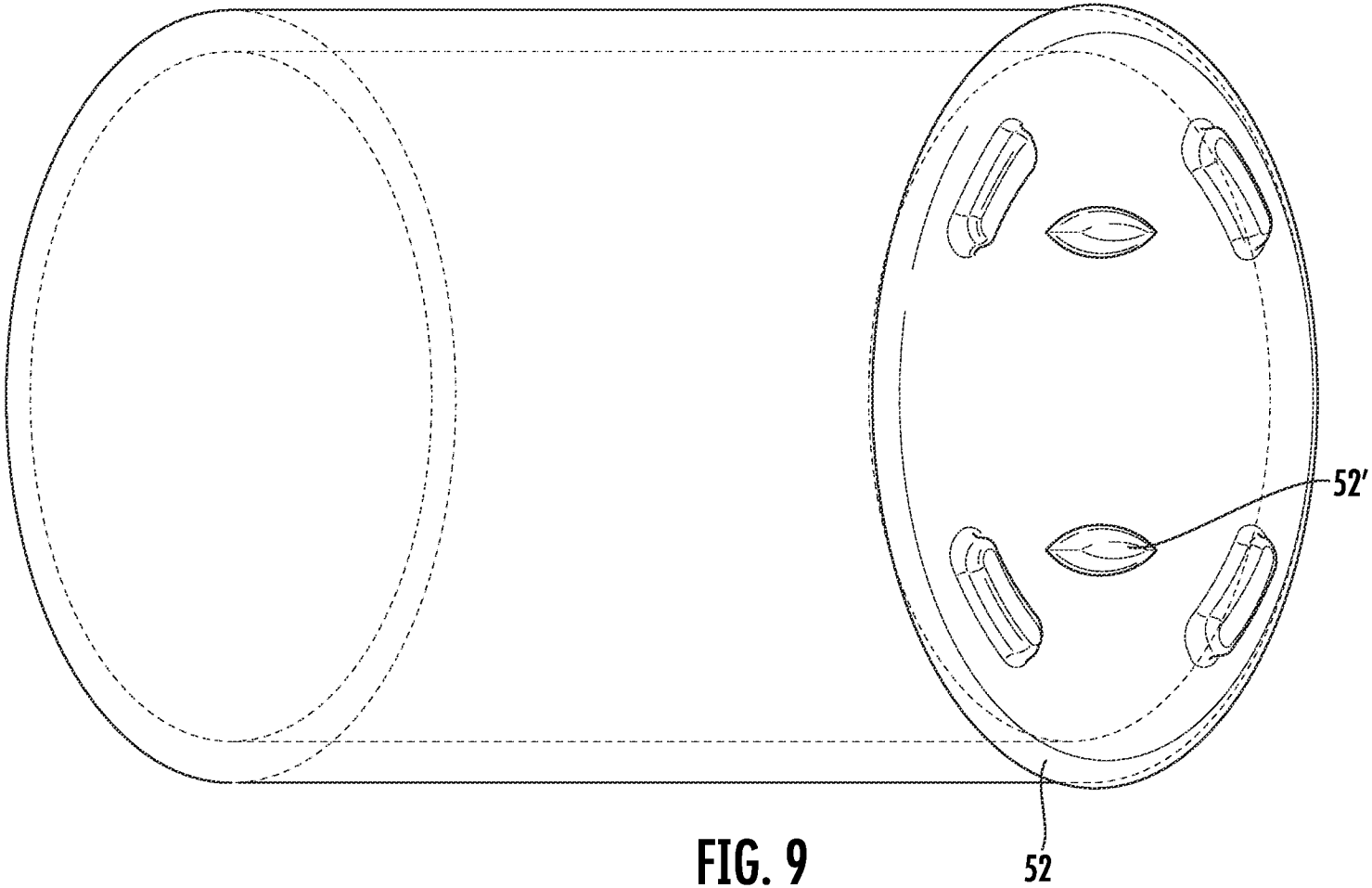
FIG. 9 is a plan view of a further alternate embodiment of the casing cylinder.

FIG. 9 illustrates another variation where members 52' are concentric, but unaligned with members 52. It will be appreciated that there is also the possibility for alignment and unalignment in combination.

Figure 10:
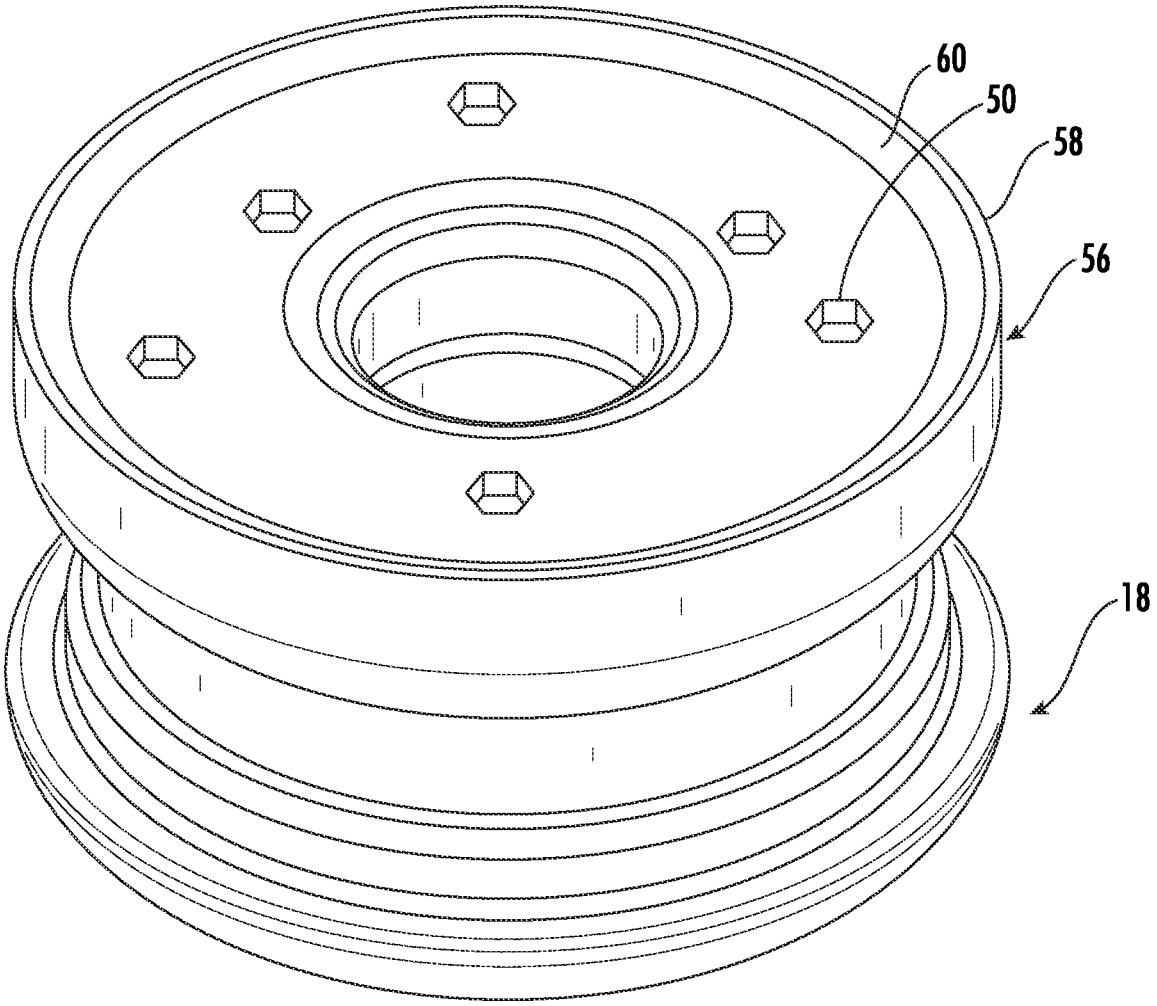
FIG. 10 is a plan view of a casing base according to a first embodiment of the invention.

FIG. 10 depicts a further variation where casing base 18 has a plurality of members 50 dispersed in an irregular pattern. This may be useful to compensate for thermal variation response when the casing base 18 and casing cylinder 32 are composed of different metals. This randomness in disposition of the members 50 when engaged with correspondingly configured members 52 on casing cylinder 32 can alleviate warping or other mechanical stresses experienced between the parts 18 and 32 during detonation.

I claim:

1. An ammunition casing assembly, comprising:

a casing base having a plurality of spaced apart first cooperating engagement members located solely on an inside a face of said casing base; and a casing cylinder having a plurality of spaced apart second cooperating engagement members located solely on an outside face of said cylinder, each first cooperating engagement member of said casing base configured for mating cooperative engagement with a respective second cooperating engagement member of said casing cylinder when said outside face is directly seated on said inside face for connection spaced from an outside face of said casing base as an assembly for preventing relative rotational movement between said casing base and said casing cylinder.

2. The casing assembly as set forth in claim 1, wherein said first cooperating engagement members comprise recesses.

3. The casing assembly as set forth in claim 1, wherein said first cooperating engagement members comprise projections.

4. The casing assembly as set forth in claim 1, wherein said first cooperating engagement members are disposed radially from a centre of said face of said casing base.

5. The casing assembly as set forth in claim 4, wherein said first cooperating engagement members have a common radius to a centre of said face of said casing base.

6. The casing assembly as set forth in claim 1, wherein said first cooperating engagement members are equidistant relative to one another.

7. The casing assembly as set forth in claim 1, wherein said casing base and said casing cylinder each include a second series of first cooperating engagement members and second series of second cooperating engagement members concentrically spaced apart from an adjacent series.

8. Firearm ammunition having a casing as set forth in claim 1.

9. A method of forming a casing for a firearm ammunition, comprising:

providing a casing base having an inside face and an outside face;

forming a plurality of spaced apart first cooperating engagement members located solely on said inside face of said casing base;

providing a casing cylinder having an inside face and an outside face;

forming a plurality of spaced apart second cooperating engagement members located solely on said outside face of said cylinder, each first cooperating engagement member of said casing base configured for mating cooperative engagement with a respective second cooperating engagement member of said casing cylinder;

contacting said inside face of said casing base to said outside face of said casino cylinder to connect said casing base and said casing cylinder, where said first cooperating engagement members and said second cooperating engagement members are in registration at the faces for preventing relative rotational movement between said casing base and said casing cylinder.

10. The method as set forth in claim 9, further including the step of mechanically connecting said base and said casing with a secondary mechanical connection.

11. A method for forming a casing for a firearm ammunition, comprising:

providing a formed ammunition casing with a base having a predetermined cross-sectional profile and Pre-existing coefficient of friction; and grinding said base with a grinder having a mating profile with said base to impart a reflective surface and reduced coefficient of friction relative to a said pre-existing coefficient of friction;

providing a casing cylinder;

forming a plurality of spaced apart first cooperating engagement members located solely on an inside face of said casing base;

forming a plurality of spaced apart second cooperating engagement members located solely on an outside face of said cylinder, each first cooperating engagement member of said casing base configured for mating cooperative engagement with a respective second cooperating engagement member of said casing cylinder; and contacting the outside face and inside face to connect said casing base and said casing cylinder, where said first cooperating engagement members and said second cooperating engagement members are in registration for preventing relative rotational movement between said casing base and said casing cylinder.

12. The method as set forth in claim 11, further including the step of mechanically connecting said base and said casing with a secondary mechanical connection.

* * * * *